US005748151A

United States Patent [19]

Kingston et al.

[11] Patent Number: 5,748,151

[45] Date of Patent: May 5, 1998

[54] LOW RADAR CROSS SECTION (RCS) HIGH GAIN LENS ANTENNA

[75] Inventors: Samuel C. Kingston, Salt Lake City; Robert B. Burdoin, Sandy, both of Utah; David Lamensdorf, Arlington, Mass.

[73] Assignee: Lockheed Martin Corporation, Bethesda, Md.

[21] Appl. No.: 217,378

[22] Filed: Dec. 17, 1980

[51] Int. Cl.[6] ..... H01Q 19/06

[52] U.S. Cl. ..... 343/753; 343/911 L

[58] Field of Search ..... 343/753, 754, 343/839, 911 R, 911 L

[56] References Cited

U.S. PATENT DOCUMENTS

| | | |
|---|---|---|
| 3,213,454 | 10/1965 | Ringenbach . |
| 3,255,451 | 6/1966 | Wolcott . |
| 3,343,171 | 9/1967 | Goodman . |
| 3,848,255 | 11/1974 | Migdal . |
| 4,085,404 | 4/1978 | Gallant . |
| 4,090,198 | 5/1978 | Canty et al. . |

OTHER PUBLICATIONS

"Methods of Radar Cross–Section Analysis", Academic Press, New York (1968), pp. 273–280.

"Radar Cross Section Handbook", Plenum Press, N.Y., vol. 1 p. 195, by G. T. Ruck.

*Primary Examiner*—Theodore M. Blum

*Attorney, Agent, or Firm*—Robert E. Lee, Jr.; John B. Sowell; Stanton D. Weinstein

[57] ABSTRACT

A low radar cross section lens antenna having high gain is disclosed. A spherical lens having a dielectric radial gradient focuses planar RF energy coupled thereto onto a focal point on the surface of a lens located diametrically opposite from the first intersection of the plane wave and the lens. The lens partially encloses a wedge shaped RF absorbing portion having the edge of the wedge passing through the center of the lens. The lens is partially surrounded by a second RF absorbing portion having a bowl-like shape. An antenna feed having its aperture located adjacent the surface of the lens is mounted to rotate about an axis lying substantially along the edge of said wedge shaped absorbing portion. Elevation rotation means is provided to rotate the feed antenna within a slot contained within the second RF absorbing portion. The lens and wedge shaped PF absorbing portion, the second RF absorbing portion, the feed antenna and elevation rotation means are all rotatable around an axis perpendicular to the edge of the wedge.

6 Claims, 3 Drawing Sheets

LOW RADAR CROSS SECTION (RCS) HIGH GAIN LENS ANTENNA

BACKGROUND OF THE INVENTION

The present invention relates to a low radar cross section (RCS) antenna, particularly antennas requiring narrow beam widths. This application relates to U.S. application Ser. No. 06/217,379, entitled A LOW RADAR CROSS SECTION (RCS) NARROW BEAM LENS ANTENNA, filed on the same day and assigned to a common assignee.

The RCS of an object represents a measure of the amount of energy reflected by the object in a first direction when illuminated by RF energy transmitted from a second direction. If the transmitting radar device and a receiver for the reflected energy are located in substantially the same place, the first and second directions are the same and the reflected RF energy from the illuminated object represents the RCS back scatter of the object. Otherwise, the RCS energy measured is referred to as a bi-static RCS.

Antenna apertures provide an efficient transition between RF energy travelling through free space (radiated energy) and RF energy travelling in transmission lines within a pre-determined frequency band of operation (band width). One important characteristic of an antenna is its radiation pattern, which is a measure of the amplitude response of the antenna aperture to RF energy as a function of an angle of rotation about the aperture. Antenna patterns are usually measured by connecting the antenna to a receiver and connecting the receiver to a pattern recorder. The antenna is mounted on a turntable which is rotatable about an axis passing through the phase center of the antenna. Narrow bandwidth RF energy is transmitted from a single direction and received by the antenna as it rotates. The pattern recorder moves paper in synchronism with the antenna rotation and the amplitude of energy received by the antenna is recorded on the moving paper as a function of rotation angle. It is well known in antenna theory that the transmit pattern of the antenna is identical to the receive pattern. Antenna apertures which receive RF energy with greater strength from a first angular region, compared to other angular regions, form a beam in their pattern in the preferred direction and are said to have gain in that direction. The higher is the gain, the narrower the beam. High gain antennas are also characterized by low level secondary beams called side lobes. The direction of the center of the main beam of high gain antennas is called the electrical boresight of the antenna.

It is sometimes desirable to equip low RCS vehicles with high gain antennas. It then becomes necessary to provide high gain antennas with low RCS characteristics. However, high gain, narrow beam width, low side lobe antennas require large apertures, that is, large surfaces or dimensions which makes it difficult to provide low RCS characteristics. Typical high gain antennas comprise parabolic dish reflectors illuminated by special feed arrangements located at the focus of the parabola, and the reflecting surfaces from such dish reflectors cause high back scatter and bi-static RCS levels because of the size and shape of the reflecting surface.

Relatively high gain antennas have been designed using combinations of feed antennas and Luneberg-type dielectric spheres. The well-known Luneberg sphere focuses plane wave RF energy incident on the sphere to a point on its surface opposite the initial point of intersection of the plane wave with the sphere. If an antenna aperture is placed adjacent to the sphere at the focal point, its gain is effectively increased because of the larger size and focusing characteristics of the sphere. See, for example, U.S. Pat. No. 3,848,255, entitled "Steerable Radar Antenna". However, no attempt was made in the prior art to lower the RCS of the antenna-sphere combination in the aforementioned patent.

SUMMARY OF THE INVENTION

The present invention comprises a low RCS, high gain, low side lobe lens antenna having a substantially spherical dielectric lens with a dielectric value gradient disposed along the radius of the lens. The gradient is formed to provide a focal point located at the periphery of the sphere for plane wave RF energy coupled to the lens. The focal point is located diametrically opposite the point of intersection between the RF plane and the spherical lens.

The antenna further comprises a first RF absorbing portion located within the lens and a second RF absorbing portion partially surrounding the lens, including that portion of the lens containing the first RF absorbing portion. In the preferred embodiment, the second RF absorbing portion is a body of rotation defined by an axis of rotation which passes through the center of the substantially sperical lens.

Also, in the preferred embodiment, the lens is truncated to form a flat base on the first RF absorbing portion. The second RF absorbing portion comprises a flat base portion and a curved peripheral portion. When the lens and second RF absorbing portion are placed together, the flat base of the first RF absorbing portion engages the flat base of the second RF absorbing portion, and the curved portion of the second RF absorbing portion engages a portion of the spherical surface of the lens.

The lens antenna further comprises a directional feed antenna having an electrical bore sight, the antenna disposed to rotate within a slot in the second RF absorbing portion along a portion of the surface of the lens. In the preferred embodiment, the feed antenna rotates in a plane which contains the axis of rotation of the second RF absorbing portion (elevational plane) with the electrical bore sight of the antenna passing through the center of the lens. The antenna rotates from a first position to a second position through a predetermined number of degrees of rotation.

The lens antenna, including the lens, first and second RF absorbing portions, and feed antenna, are supported on a rotatable platform which is free to rotate through 360 degrees about the axis of rotation of the second RF absorbing portion.

The objects, features and advantages of the present invention will become more fully apparent from the following detailed description of the preferred embodiment, the appended claims and the accompanying drawings in which:

DETAILED DESCRIPTION OF THE DRAWINGS

Figure 1:
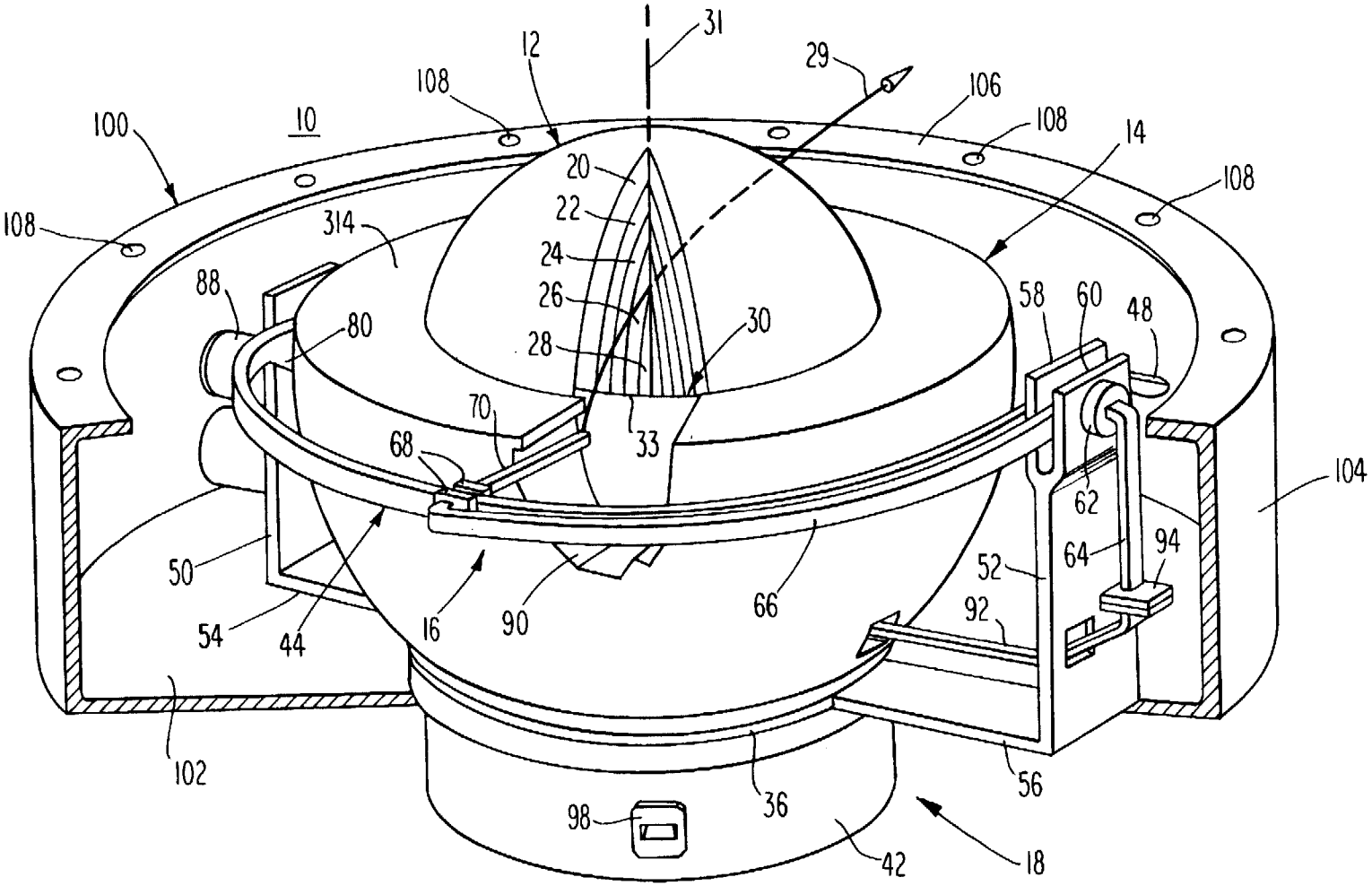
FIG. 1 is a perspective view of the preferred embodiment of the present invention showing a section cut away.

Operation of the preferred embodiment, low RCS, high gain lens antenna designated generally 10 of FIG. 1 depends upon the characteristics of a spherically stratified lens having a radial dielectric gradient approximating the equation, $$E=2-(R/R_O)^2$$

Where E is the dielectric constant, $R_O$ is the radius of the lens, and R is the distance from the center of the lens to a point on the path traveled by a ray of RF energy within the lens. A lens with this dielectric gradient has been described in the literature, see "Methods of Radar Cross Section Analysis", Academic Press, 1968, pp. 273–279.

Figure 2:
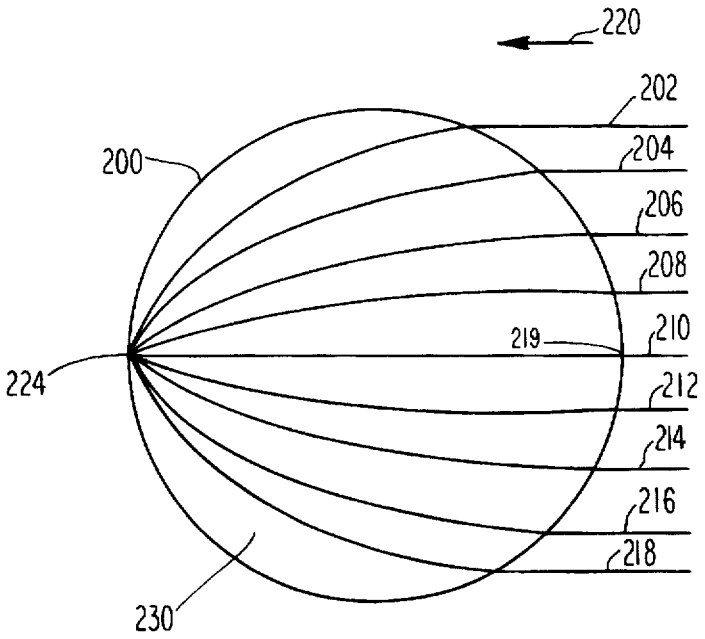
FIG. 2 depicts a plane through the origin of a spherical dielectric lens having a predetermined radial dielectric gradient and coupled with a plane wave front of RF energy.

Referring to FIG. 2, interaction of RF energy with a lens having the theoretical dielectric gradient given by the equation above, is depicted in cross-section. RF energy travelling through free space at great distances from its origin, travels in planar wave fronts in a direction which is perpendicular thereto. The RF energy can be characterized as parallel rays of RF energy emanating from points on the planar wave front and travelling in a direction parallel to the direction of travel of the planar wave front. In FIG. 2, a plane wave of RF energy is shown as even-numbered rays 202 through 218, travelling in the direction of line and arrow 220. The planar wave front first intersects the sphere at point 219, but once inside the sphere, the rays travel along curved paths (except ray 210, which passes through the center of the sphere) and converge on the focal point 224 on the periphery of the sphere, diametrically opposite the point 219. The dielectric constant of the sphere in a region near the periphery is approximately 1.0, the same as free space. Accordingly, even-numbered rays 202 through 218 enter the sphere 200 with little or no reflections and leave sphere 200 through point 224 with little or no reflection. Hence, the radar backscatter is minimal. All rays travelling in a direction parallel to line and arrow 220 after entering the sphere will pass through the focal point 224. The maximum dielectric constant attained within the sphere occurs in the center and has a value 2.0.

FIG. 1 shows a low RCS lens antenna designated generally 10 comprising a lens designated generally 12; a bowl-like RF absorbing portion designated generally 14; a feed antenna assembly designated generally 16; and a rotatable support assembly designated generally 18. The lens 12 is generally spherical in shape, and formed from a plurality of even-numbered concentric dielectric shells 20–28. Only five shells are shown for simplicity, but, typically, many more than five shells are used to form the lens. The outermost shells will have a dielectric constant near 1.0 to provide a good impedance match with free space (thereby minimizing reflections at the lens surface) while the innermost shell (or center spherical ball) will have a dielectric constant of 2.0. Planar energy impinging on the lens 12 will be focused to a single point on the periphery of the lens. See typical ray 29.

The antenna further comprises a first RF absorbing portion designated generally 30 contained within lens 12. In the preferred embodiment, the first RF absorbing portion comprises a wedge shaped portion of a sphere having two flat sides which meet along a substantially straight edge 33. The straight edge formed by the flat sides lies along a diameter of lens 12 and is substantially equal to it in length. In an alternate embodiment, first RF absorbing portion 30 has a conical shape with its axis of rotation passing through the center of the lens 12 and its apex located at or near the center. First RF absorbing portion 30 is formed to have a dielectric constant which varies in accordance with the equation of page 5 where first RF absorbing portion 30 is to be considered as forming part of substantially spherical lens 12 for purposes of the equation of page 5.

Figure 3:
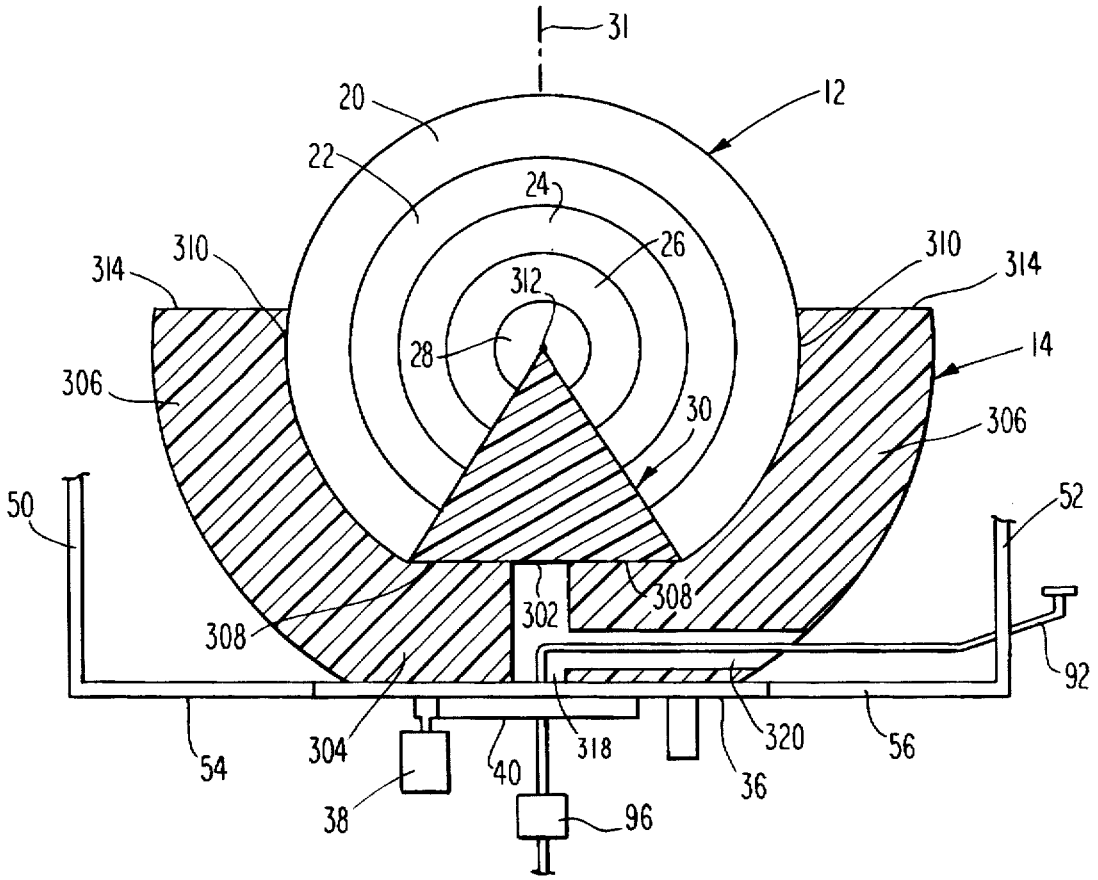
FIG. 3 is a partial cross sectional view of a portion of FIG. 1.

FIG. 3 is a cross-sectional view of the lens 12 taken through the center of lens 12 (showing the shells 20–28 and first RF absorbing portion 30) and second RF absorbing portion 14 having a bowl-like shape. Lens 12 is, for the most part, spherical but it is truncated through the first RF absorbing portion 30. This forms a flat circular surface 302 on the first RF absorbing portion 30. Notice that the cross section of first RF absorbing portion 30 as shown in FIG. 3 is triangular in shape.

The bowl-like absorbing portion 14 is in the preferred embodiment, a body of revolution having an axis of revolution 31. It comprises a flat base portion 304 and curved peripheral portion 306 connected to flat base portion 304. Bowl-like absorbing portion 14 is disposed to receive lens 12 and first RF absorbing portion 30 such that the flat circular surface 302 of first RF absorbing portion engages a flat surface of flat base portion 304 along interface 308 while the inner curved surface of peripheral portion 306 engages a portion of the spherical surface of lens 12 along interface 310. Hence, in the preferred embodiment, lens 12 and first RF absorbing portion 30 fit into bowl-like RF absorbing portion 14. The axis of rotation of absorbing portion 14 passes through the center of lens 12 perpendicular to the straight edge 33 of first RF absorbing portion 30. An imaginary plane cut through spherical center 312 of lens 12 perpendicular to the axis of rotation 31 is called the equatorial plane. Curved peripheral portion 306 extends from base portion 304 along the surface of lens 12 at least as far as the equatorial plane. In FIG. 3, the end surface 314 is shown in a plane above the equatorial plane but parallel thereto. See the angular ring surface 314 of peripheral portion 306. In an alternate embodiment, bowl-like absorber 14 has a cylindrical shape with lens 12 partially fitting within the cylinder and partially protruding therefrom.

The flat base portion 304 further comprises two cavities 318 and 320. In the preferred embodiment, the cavities are cylindrical in shape, and the axis of cavity 318 is colinear with axis 31. Cavity 318 extends through flat portion 304. Cavity 320 has an axis which is transverse to cavity 318 and the cavity 320 extends through peripheral portion 306 to communicate between cavity 318 and the ambient atmosphere.

Referring now to FIGS. 1 and 3, rotatable support assembly 18 comprises a rotatable flat support plate 36 upon which the bowl-like RF absorbing portion 14 rests and is attached. A motor 38 and gear arrangement 40 located within the housing 42 of drive assembly 18 is capable of rotating the plate and lens antenna through 360 degrees about the axis 31 of the lens 12. Further electro-mechanical details of turntable design such as slip ring assemblies and bearing designs are believed to be conventional in the art and are not presented here.

Figure 4:
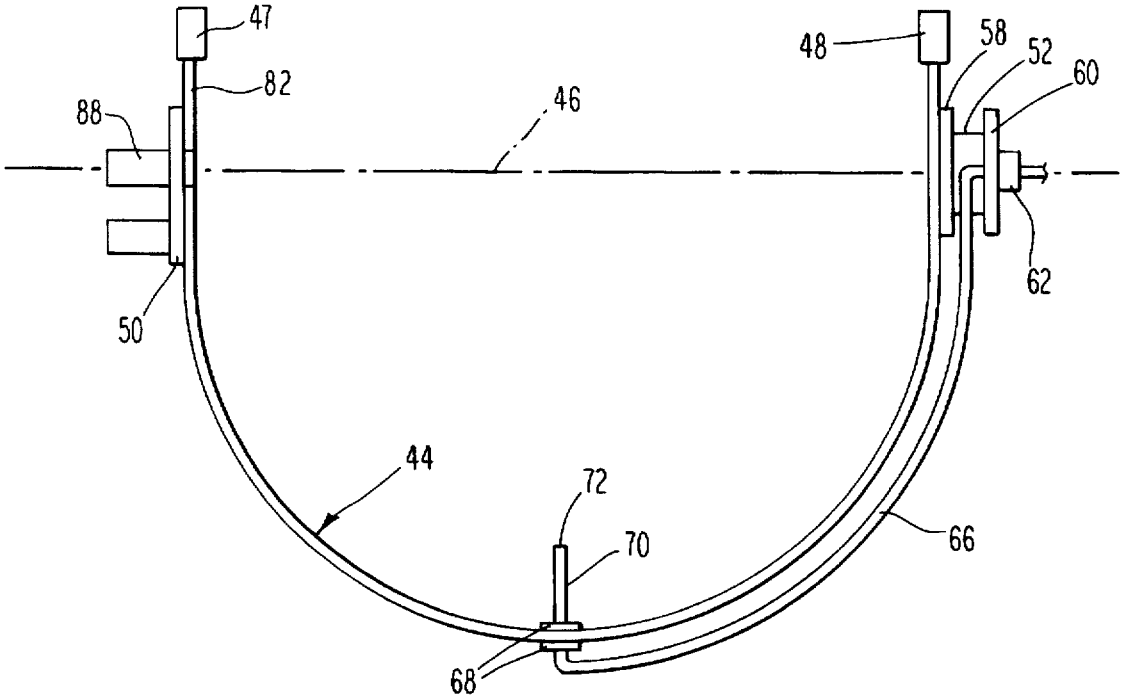
FIG. 4 is a top view of a first portion of FIG. 1.

Referring now to FIGS. 1, 3 and 4, the antenna assembly 16 comprises a semicircular support arm designated generally 44 which is rotatable about an axis 46. Counterweights 47 and 48 are connected to either end of support arm 44 to balance the weight of arm 44 about the rotation axis 46. Support arm 44, including weights 47 and 48, are pivotally mounted to transverse members 50 and 52 along the axis 46. Transverse members 50 and 52 are connected to support plate extension portions 54 and 56, which are attached to support plate 36 and extend away therefrom in opposite directions in the same plane as support plate 36. Transverse member 52 terminates in a forked end portion having two substantially parallel plates 58 and 60. Support arm 44 is pivotally attached to plate 58 while an RF rotary joint 62 is attached to plate 60. One end of rotary joint 62 is connected to RF wave guide member 64, while the other end is connected through plate 60 to a curved wave guide feed member 66. In the preferred embodiment, the axis of rotation 46 passes through the center of lens 12 which is also the center of the curvature of curved arm 44. The radius of curved arm 44 is larger than the radius of lens 12.

The wave guide feed member 66 is aligned with curved arm 44, having a substantially common center of curvature and lying in the same plane as curved arm 44. The curved wave guide feed member 66 bends inwardly and is attached to curved arm 44 by bracket 68 at a location which is approximately equidistant from either end of curved arm 44. It extends inwardly as a wave guide feed antenna 70 toward the center of curvature of the curved arm 44 and curved wave guide 66. The radiating aperture of wave guide feed 70 is its open end 72. The mechanical and electrical bore sight of open end wave guide feed antenna 70 is directed toward the center of lens 12.

Figure 5:
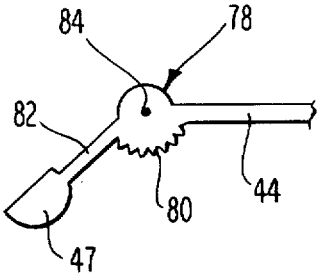
FIG. 5 is a side view of a portion of FIG. 4.

Further details of the end of curved arm 44 connected to weight 47 are provided in FIG. 5. Curved arm 44 comprises an intermediate portion designated generally 78 including a curved toothed portion 80. The intermediate portion 78 is connected to weight 47 by an extension 82 of curved arm 44. Extension 82 is transverse to the plane containing the curved portion of arm 44. Intermediate plate 78 is pivotally connected at point 84 to transverse member 50.

Referring to FIG. 4, a motor 88 is mounted to transverse member 50 on an opposite side from intermediate portion 78. A geared shaft of motor 88 passes through member 50 and is so disposed to engage rotatably the curved gear portion 80 of intermediate portion 78. When the shaft turns, curved arm 44 is caused to rotate about the axis 46 passing through pivot point 84.

Curved antenna feed 66 rotates with curved arm 44 since it is attached thereto by brackets 68. It is also attached to the rotary joint 62 at plate 60. The rotary joint allows the antenna feed 66 to rotate while still maintaining RF transmission from wave guide portion 64 to curved wave guide portion 66 without RF reflections and losses. As the feed antenna 66 and arm 44 rotate, the wave guide feed antenna 70 moves within a slot in bowl-like RF absorber 14. In FIG. 1, only one wall 90 of the slot is shown, since the absorber portion 14 is cut away at the slot to partially expose the first RF absorbing portion 30. As the feed antenna 70 rotates, the aperture 72 travels in close proximity to the spherical surface of lens 12 along a curved path within an elevational plane of lens 12. As it does so, the bore sight of feed antenna 70 is always directed toward the center of lens 12.

Referring to FIGS. 1 and 3, wave guide portion 64 is connected to a bent wave guide portion 92 by brackets 94. Bent portion 92 passes through an opening in transverse member 52 and enters cavity 320 in bowl-like RF absorber 14. At the intersection between cavity 320 and cavity 318, bent portion 92 bends again to pass through cavity 318 along its axis, where it is connected to azimuthal RF rotary joint 96. The other end of rotary joint 96 is connected to wave guide port 98 on the outer surface of housing 42. Energy fed into port 98 will travel through rotary joint 96, bent wave guide 92, wave guide portion 64, elevational rotary joint 62, curved wave guide portion 66, feed antenna 70, aperture 72, and lens 12. Energy entering lens 12 in a direction parallel to the bore sight of feed antenna 70 will reverse this path to be provided at port 98. It can be appreciated from observing FIG. 1 that the exposed surface of the lens 12 above annular surface 314 provides a large collecting aperture for the much smaller aperture 72 of feed antenna 70. The focusing characteristics of the lens 12 provides the captured RF energy to the aperture 72 in phase. The result is a lens feed antenna aperture which provides high gain and narrow beam width.

RF energy impinging lens 12 can come from more than one direction. For example, it can have a direction with an azimuth angle anywhere in the 360 degrees around axis 31. It can have a direction with an elevation angle anywhere from 0 degrees (when it is parallel to the equatorial plane or horizon) to 90 degrees (parallel to the axis 31). Depending on the direction of travel, the focal point of the rays entering lens 12 will occur on a point on the surface of the sphere as described earlier. In order to capture the focused energy, aperture 72 must be moved to the focal point for each different direction of the desired RP energy. This is accomplished by rotating plate 36 about axis 31, changing the azimuth direction; and by rotating arm 44 and curved antenna 66 about axis 46, changing the elevation angles. In the preferred embodiment, the elevation angle can be varied from 0 degrees to an elevation approximating 45 degrees.

Figure 6:
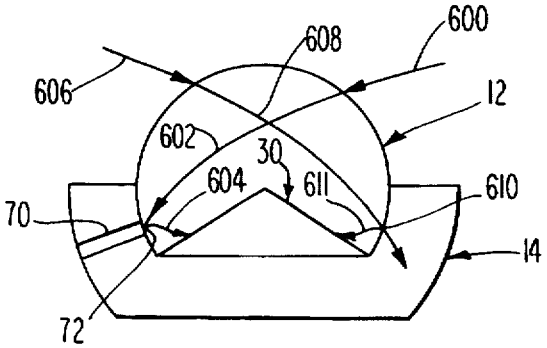
FIG. 6 is a plane through the origin of a second portion of FIG. 1 showing a pair of rays of RF energy coupled thereto.

FIG. 6 shows what happens to two different rays of RF energy incident on lens 12 at the same time. In FIG. 6, it is desired to collect RF energy incident from a direction parallel to ray 600, which is approximately 30 degrees in elevation, or 30 degrees above the equatorial plane. All rays parallel to ray 600 come in from a direction of ray 600 and when coupled to the exposed surface of lens 12 will be focused on aperture 72. See the curved path 602 travelled by ray 600 within lens 12. Although in theory the focused energy passes through the surface of lens 12 into aperture 72, in practice, the surface will cause some internal and unwanted reflection of the RP energy. This is represented by ray 604. Ray 604, then, passes into first RF absorber 30 where it is absorbed and cannot contribute to the RCS of the lens antenna. It can be expected that the reflected angle of ray 604 from the focal point will be equal and opposite to the incident angle of ray 602 on the focal point. Accordingly, almost all energy coupled to the lens 12 which causes internal reflection will result in reflected energy being absorbed by first RF absorbing portion 30 since most incident energy will be from a direction above the equatorial plane.

At the same time, energy represented by ray 606 is incident on lens 12 from a different direction than ray 600. This ray represents illumination of the lens antenna 10 by a tracking radar, for example. In general, it will have a different frequency than the frequency of lens antenna 10 but it does not have to be different. Ray 606 travels along curved path 608 within lens 12 and is focused at point 610 on the surface of the lens. Most of the focused energy will pass through point 610 into bowl-like absorber 14 where it will be absorbed. However, some of the RF energy will be reflected (such as ray 611) at the surface of the lens into first RF absorbing portion 30. Hence, the reflected RF cannot contribute to the RCS of the lens antenna.

In the usual case, the lens antenna will be mounted in a cavity in a host platform, such as an aircraft or ship. In FIG. 1, the cavity is defined by the cylindrical supporting structure designated generally 100. It comprises a back plate 102, a circular side wall 104, and a flange 106 with rivet or bolt holes 108. Lens antenna 10 is suitably mounted within the cavity to the supporting structure, and the supporting structure is suitably mounted to the platform by rivet or bolt holes 108.

If the lens 12 were not partially surrounded by bowl-like absorber 14, energy passing through the lens such as ray 608, would enter into the cavity defined by supporting structure 100. The cavity represents a large radar cross section contributor and would reflect the energy back into the ambient atmosphere. Hence, the first RF absorber 30 absorbs internal RF energy including internal reflections, and the bowl-like absorber 14 absorbs RF energy that would otherwise be reflected by the cavity.

Remembering that first RF absorbing portion 30 extends within lens 12 in a direction perpendicular to the plane of FIG. 6, RF energy impinging on lens 12 in a plane substantially perpendicular to the plane of FIG. 6 and at an incident angle greater than 0° in elevation, particularly at elevation angle 30° and above, will pass into first RF absorbing portion 30 before being focused to a point. This results in greater absorption of this energy and minimizes internal reflections of this energy such as that which occurs at point 610 in FIG. 6.

While the present invention has been disclosed in connection with the preferred embodiment thereof, it should be understood that there may be other embodiments which fall within the spirit and scope of the invention as defined by the following claims.

What is claimed is:

1. A low radar cross section (RCS) lens antenna arrangement comprising:

a lens means having a dielectric radial gradient and formed substantially spherical such that RF energy transmitted in a plane configuration to said lens and having a direction of travel prior to impinging said lens which is perpendicular to said plane passes through said lens means so as to be focused onto a focal point on the surface of said lens opposite the intersection of said plane wave and said lens;

first and second RF absorbing means formed to absorb RF energy impinging thereon; said first RF absorbing means designed to absorb energy comprising energy reflected internally in said lens; said second RF absorbing means designed to absorb RF energy passing through said lens; and an antenna feed located within said second RF absorbing means and having an aperture adjacent a predetermined focal point on the surface of said lens whereby RF energy focused on said predetermined focal point is captured by said antenna feed and not absorbed by said second absorbing means.

2. The invention of claim 2 wherein said second RF absorbing portion has a slot contained therein; wherein said antenna feed is located within said slot and is free to rotate within said slot about a first axis passing through the center of said lens; and wherein said lens antenna arrangement further comprises elevation rotation means for rotating said antenna feed about said first axis.

3. The invention of claim 2 wherein the bore sight of said antenna feed is always directed toward the center of said lens.

4. The invention of claim 3 wherein said lens antenna comprises azimuth means for rotating said lens, said first RF absorbing portion, and said feed antenna through 360° about a second axis substantially perpendicular to said first axis.

5. The invention of claim 4 wherein said first RF absorbing portion is substantially wedge shaped and is disposed within a wedge shaped void within said lens with the edge of said wedge lying along said first axis.

6. The invention of claim 5 wherein said second RF absorbing portion engages a portion of said lens and the surface of said wedge shaped RF absorbing portion opposite said edge of said wedge shaped RF absorbing portion.

* * * * *